United States Patent [19]

Yamaguchi et al.

[11] 4,381,727

[45] May 3, 1983

[54] SEALING AGENT INJECTING MACHINE

[75] Inventors: Etsuji Yamaguchi; Hideo Hotta, both of Tokai, Japan

[73] Assignee: Aron Kasei Co., Ltd., Tokyo, Japan

[21] Appl. No.: 180,415

[22] Filed: Aug. 22, 1980

[30] Foreign Application Priority Data

| | | | |
|---|---|---|---|
| Aug. 24, 1979 | [JP] | Japan | 54/117314[U] |
| Feb. 15, 1980 | [JP] | Japan | 55/018162 |
| Feb. 15, 1980 | [JP] | Japan | 55/018626[U] |
| Jun. 17, 1980 | [JP] | Japan | 55/085092[U] |

[51] Int. Cl.[3] ..... B05C 5/02; B05C 7/06

[52] U.S. Cl. ..... 118/408; 118/410

[58] Field of Search ..... 118/408, 410, 305, 207, 118/108; 401/137, 139, 265, 266; 222/566; 239/150; 427/136; 74/710, 674

[56] References Cited

U.S. PATENT DOCUMENTS

| | | | |
|---|---|---|---|
| 1,835,412 | 12/1931 | Livingood | 74/710 X |
| 2,026,870 | 1/1936 | Dalton | 118/305 X |
| 2,871,817 | 2/1959 | Fasold et al. | 118/410 X |
| 3,239,147 | 3/1966 | Sweet | 239/150 |
| 3,594,089 | 7/1971 | Powell et al. | 401/266 X |
| 3,627,435 | 12/1971 | Hendershot | 401/265 |

*Primary Examiner*—John P. McIntosh

*Attorney, Agent, or Firm*—Cooper, Dunham, Clark, Griffin & Moran

[57] ABSTRACT

A sealing agent injecting machine which comprises: a base having wheels, a driving system of said wheels installed in said base, a vessel containing sealing agent, connected with a nozzle and mounted on the base, and a pressure apparatus putting pressure into said vessel, is provided in the present invention. Sealing agent is injected into joint of covering materials such as floor covering by using said machine and said machine can rightly follow the joint by providing differential gear in the driving system.

4 Claims, 20 Drawing Figures

FIG. 3
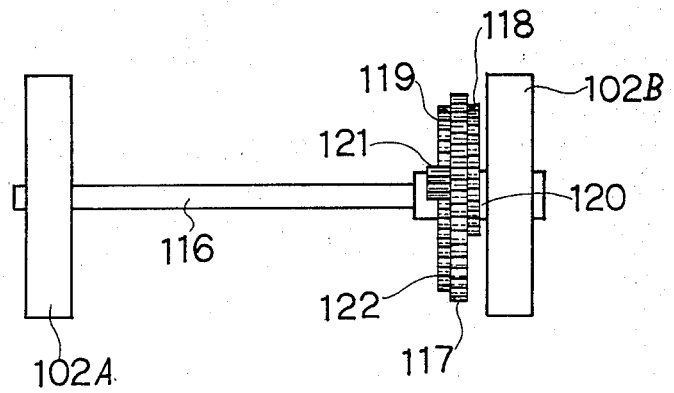
FIG. 4
FIG. 5
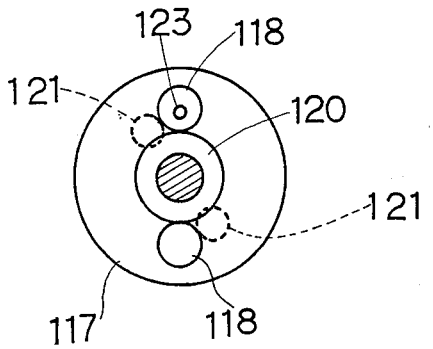
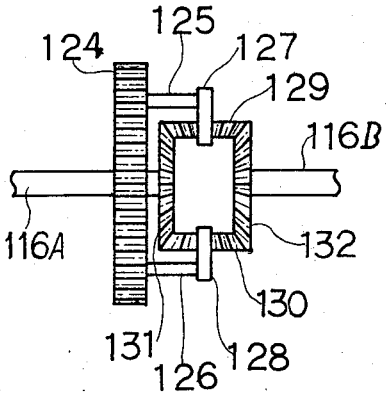
FIG. 6
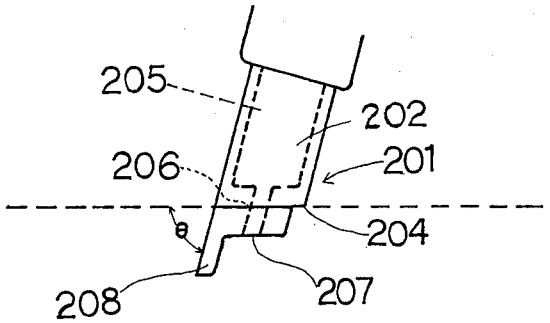

SEALING AGENT INJECTING MACHINE

BACKGROUND OF THE INVENTION

1. Field of the Invention

The present invention relates to a sealing agent injecting machine. More particularly, the present invention relates to a sealing agent injecting machine which comprises a base having wheels, a driving system of said wheels installed in said base, a vessel containing sealing agent, connecting with a nozzle and mounted on the base; and a pressure apparatus putting pressure into said vessel. Furthermore, the present invention relates to a sealing agent injecting machine providing differential gear in its driving system.

2. Description of the Prior Arts

Hitherto, sealing agent has been applied into the joint of the covering materials such as the floor coverings in such a way as that a nozzle 803 attached to a plastic bottle 801 containing sealing agent is inserted into the joint 805 of the coverings 804 and the plastic bottle 801 is moved along the joint 805 in the direction as indicated by an arrow in FIG. 1 with pressing the bottle 801 by hand to inject the sealing agent into the joint 805 from the nozzle 803 as shown in FIG. 1. Above mentioned manual operation has insufficient work efficiency since workers must handle in a crouching and uneasy posture, and the strong grasping power is necessary to push out the sealing agent from the nozzle because the sealing agent has generally high viscosity. Further a great deal of skillfulness is required for letting the nozzle follow rightly to the joint of the coverings. Furthermore, it is difficult to obtain a constant grasping power which is influential to injecting amount of the sealing agent into the joint of the coverings, so a great deal of skillfulness is also necessary to inject the proper amount of the sealing agent into the joint of the coverings.

SUMMARY OF THE INVENTION

An object of the present invention is to avoid the manual operation in which high work efficiency is not expected, and a crouching and uneasy posture of workers is required while injecting sealing agent.

Another object of the present invention is to obtain an proper injecting amount of the sealing agent into the joint of the coverings.

Further object of the present invention is to let the sealing agent injecting machine follow rightly the joint of the coverings.

Said objects can be attained by using a sealing agent injecting machine which comprises: a base having wheels, a driving system of said wheels installed in said base, a vessel containing sealing agent, connecting with a nozzle and mounted on the base, and a pressure apparatus putting pressure into said vessel and said machine can rightly follow the joint by providing differential gear in the driving system.

BRIEF DESCRIPTION OF THE DRAWINGS

FIG. 3 is a front view showing an embodiment of the differential gear;

FIG. 4 is a side view showing said embodiment of the differential gear;

FIG. 5 is a partial front view showing another embodiment of a differential gear;

FIG. 6 is a side view showing an embodiment of the nozzle;

DETAILED DESCRIPTION OF THE PREFERRED EMBODIMENTS

Figure 1:
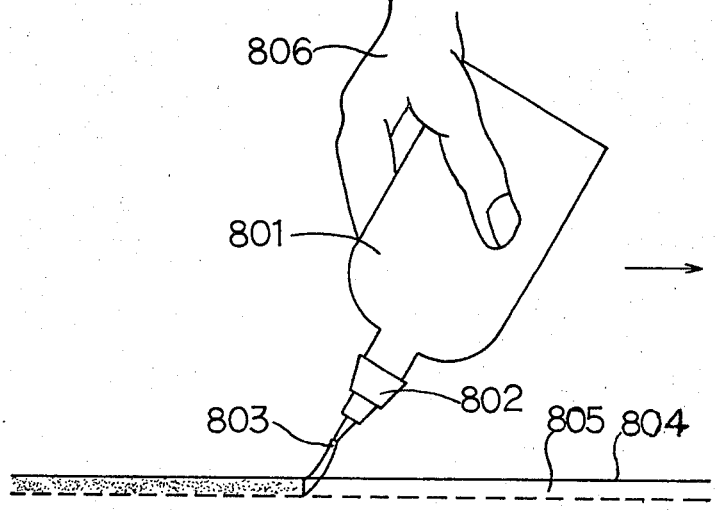
FIG. 1 PRIOR ART
FIG. 1 shows a side view of a prior art.

A sealing agent injecting machine of the present invention comprises: a base having wheels, a driving system of said wheels installed in said base, a vessel containing sealing agent, connecting with a nozzle and mounted on the base, and a pressure apparatus putting pressure into said vessel.

Referring now to FIG. 2 to FIG. 5, 101 is a base having a pair of main-wheels 102A, 102B in the middle part and a sub-wheel 103 in the front part of the bottom of said base 101. Said main-wheels 102A, 102B are driven by the driving system comprising a motor 105 and a chain 104 which is suspended between pulley 105A attached to an axis of said motor 105 and a gear system of the main-wheels 102A, 102B. A compressor 106 is installed behind the motor 105 on the base 101. The motor 105 and said compressor 106 connect with a lead wire 107 respectively and the motor 105 and the compressor 106 are driven the electric current from said lead wire 107. A variable speed motor of which rotational speed is remote-controlled by the phase control or the voltage control is preferably used as the motor 105. A pressure pipe 109 having a valve 108 is connected with the compressor 106 and said pressure pipe 109 is also connected with a vessel 110 containing sealing agent attaching a pressure gage 113, and installed on the front part of the base 101. The motor 105 and the compressor 106 are covered with a cover 114. Further, a valve 112 is connected with the upper end of said vessel 110 and a pressure pipe 111 connects with said valve 112. Said pressure pipe 111 is perpendicularly bended and a supporter 115 supporting a nozzle 201 is connected with the lower end of the pressure pipe 111.

Said gear system of the main-wheels in above mentioned machine comprises a differential gear as shown in FIG. 3 and FIG. 4. Referring to FIG. 3 and FIG. 4, one of main-wheels 102A is fixed on a wheel axis 116 while another main-wheel 102B is rotatably attached to said wheel axis 116. Further a driving gear 117 suspending said chain 104 is rotatably attached to the axis 116 and an axis 123 rotatably passes through the side face of said driving gear 117. A pair of pinions 118, 119 are fixed to the both sides of said axis 123 respectively. One pinion 118 gears with a fixed gear 120 which is fixed on the reverse side of the main-wheel 102B and another pinion 119 gears with an idle pinion 121 which is rotatably attached to the one side of the driving gear 117, and then said idle pinion 121 gears with a fixed gear 122 which is fixed to the wheel axis 116. In above mentioned differential gear, when the main-wheel 102B is rotated, said rotation of the main-wheel 102B is transmitted to said fixed gear 120, the pinions 118, 119 and then the main-wheel 102A. The main-wheel 102A rotates in opposite direction against the rotating direction of the main-wheel 102B since said idle pinion exists between the pinion 119 and said fixed gear 122. Thus the differential gear is applied between the main-wheel 102A and the main-wheel 102B. Idle pinions which connect with the pinion 118 might be also rotatably attached to another side of the driving gear 117. In this case, the number of idle pinions in the pinion 119 side should be odd number when the number of idle pinions in the pinion 118 side is even number and the number of idle pinions in the pinion 119 side should be even number when the number of idle pinions in the pinion 118 side is odd number.

Another differential gear which is applicable in the present invention is shown in FIG. 5. A bevel gear is employed in said differential gear. Referring to FIG. 5, a driving gear 124 suspending the chain 104 is rotatably attached to one of wheel axes 116A and a pair of short axes 127, 128 are vertically supported by a pair of supporting bars 125, 126 respectively and said pair of supporting bars 125, 126 are stretched from one of side faces of said driving gear 124 respectively. A pair of smaller bevel gears 129, 130 are rotatably attached to said short axes 127, 128 respectively and said smaller bevel gears 129, 130 gear with a pair of larger bevel gears 131, 132. One of larger bevel gears 131 is fixed to an axis 116A and another larger bevel gear 132 is fixed to an axis 116B. Thus rotation of said axis 116B is transmitted to said axis 116A intermediating said larger bevel gear 132, said smaller bevel gears 129, 130 and said larger bevel gear 131. In this case, the axis 116A rotates in opposite direction against the rotating direction of the axis 116B.

Figure 7:
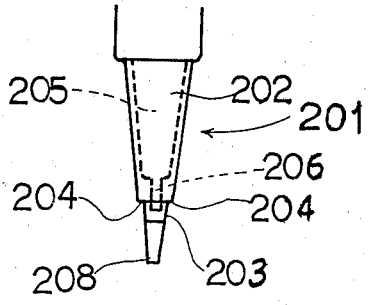
FIG. 7 is a front view showing said embodiment of the nozzle.
Figure 8:
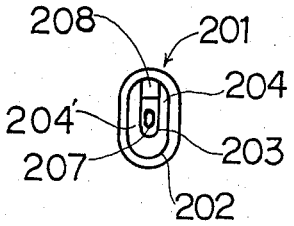
FIG. 8 is a bottom view showing the embodiment of the nozzle.

A preferred embodiment of the nozzle is shown in FIG. 6 to FIG. 8. Referring to FIG. 6 to FIG. 8, a nozzle 201 comprises a base tube 202 and an inset tube 203 which is formed under said base tube 202 and has smaller width than the base tube 202. A hole 205 is formed in the nozzle 201 and a tubular hole 206 formed in the nozzle 201 connects with the bottom of said hole 205. Said tubular hold 206 is opened to form a nozzle hole 207 at the bottom of said insert tube 203. A guide bar 208 is stretched from one side of said nozzle hole 207 at the bottom of the insert tube 203. In above mentioned nozzle 201, a border face 204 between the base tube 202 and the insert tube 203 forms an angle $\theta$ of preferably less than 90°, more preferably more than 40° with said guide bar 208.

Figure 2:
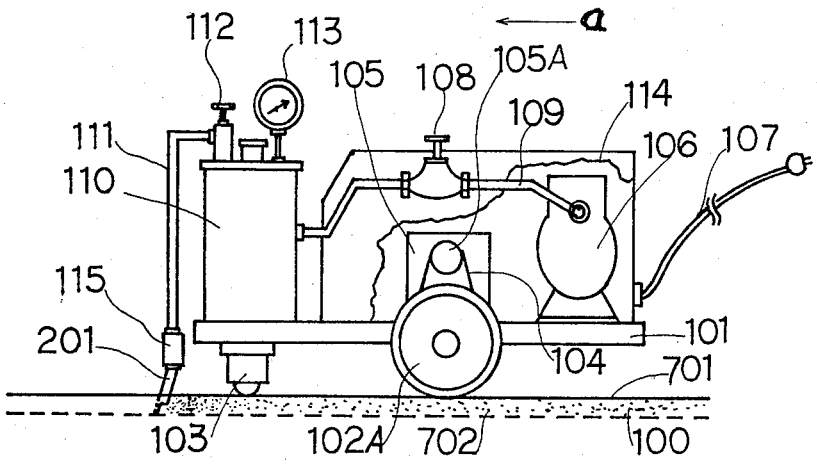
FIG. 2 is a side view partially broken away and showing an embodiment of the present invention.

In case that $\theta$ is less than 90°, the advantage is that the nozzle 201 can be smoothly thrust into the joint 702 of the coverings 701 by the wedge effect without getting off the joint 702 as shown in FIG. 2.

Figure 9:
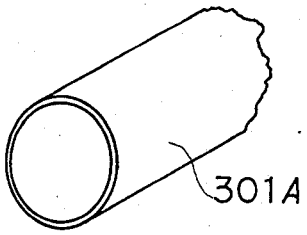
FIG. 9 is an oblique view showing another embodiment of the slender tube.
Figure 10:
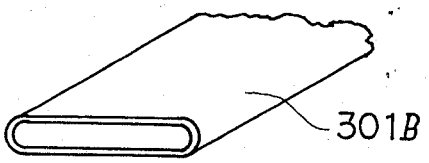
FIG. 10 is an oblique view showing said embodiment of the tube having a flat-shaped section.
Figure 11:
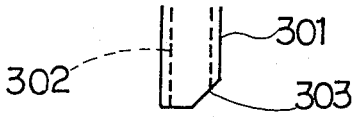
FIG. 11 is a side view showing the embodiment of the nozzle.
Figure 12:
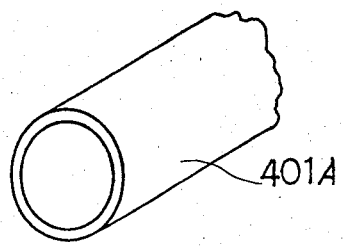
FIG. 12 is an oblique view showing a further embodiment of the slender tube.

Another preferred embodiment of the nozzle is shown in FIG. 9 to FIG. 11. Referring to FIG. 9 to FIG. 11, 301A is a slender tube made of the metal such as the injection needle and having a circular section and said tube 301A is pressed to form a tube 301B having a elliptical section. The back part of the bottom end of said tube 301B is diagonally cut to form a slanting surface 303 and thus a nozzle 301 is made. Said nozzle 301 might also have a elliptical section, guitar-shaped section and other flat-shaped section. An injecting hole 302 formed in the nozzle 301 is partially or wholly opened at said slanting surface 303 of the bottom end of the nozzle 301. In this embodiment, an advantage is that the tube having an uniform thickness of tube wall is easily produced in case that the tube has a circular section. Accordingly a nozzle having an uniform thickness of wall could be also obtained from such a circular tube having the uniform thickness of tube wall and such a nozzle having the uniform thickness of tube wall has wear resistance against rubbing with the side face of the floor.

Figure 13:
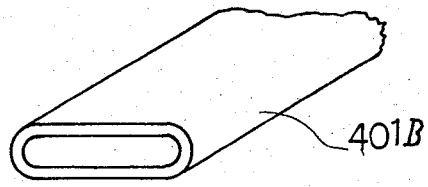
FIG. 13 is an oblique view showing said embodiment of the tube having a flat-shaped section.
Figure 14:
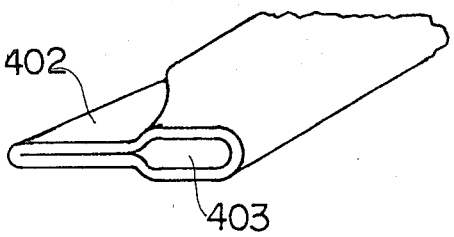
FIG. 14 is an oblique view showing the embodiment of the tube collapsed entirely its front part.
Figure 15:
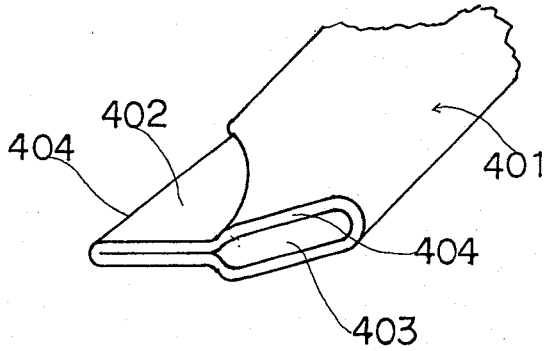
FIG. 15 is an oblique view showing the embodiment of the nozzle.

Further preferred embodiment of the nozzle is shown in FIG. 12 to FIG. 15. Referring to FIG. 12 to FIG. 15, 401A is a slender tube made of the metal such as the injection needle and having a circular section and said tube 401A is pressed to form a tube 401B having a flat elliptical section. The front part of said tube 401B is further collapsed entirely to close partially an inner hole of the tube 401B as shown in FIG. 13. The back part of the bottom end of the tube 401 is diagonally cut to form a slanting surface 404 and an injecting hole 403 is opened at said slanting surface 404 as shown in FIG. 15, and thus a nozzle 401 is made. In this embodiment, advantages are that the nozzle has uniform thickness of wall resulting a preferable wear resistance, and a front edge of the nozzle 401 forms a slanting surface 404 since the width of the front part of the nozzle 401 becomes large by collapsing and such a shape of the nozzle 401 is preferable to thrust into the joint of the coverings by the wedge effect without getting off the joint.

Figure 16:
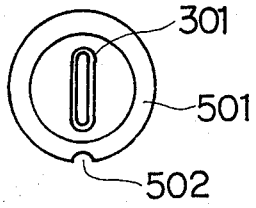
FIG. 16 is a bottom view showing the embodiment of the nozzle.
Figure 17:
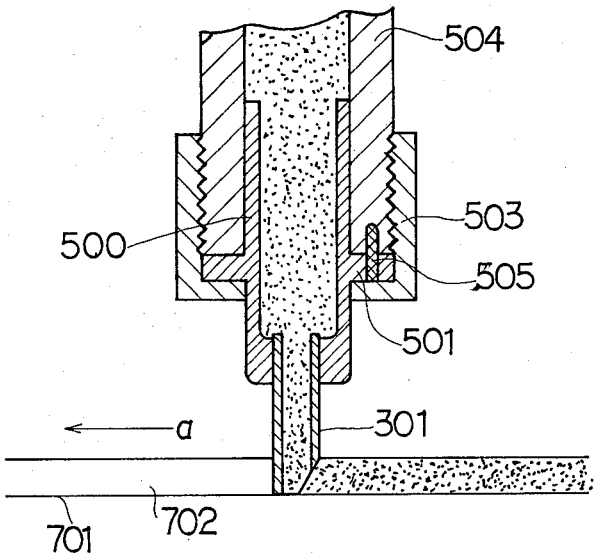
FIG. 17 is a cross-sectional view showing an embodiment of the supporter part.

An embodiment which shows a connecting mechanism of the nozzle is shown in FIG. 16 and FIG. 17. Referring FIG. 16 and FIG. 17, the nozzle 301 is connected with the lower end of a supporter 500. Said supporter 500 is tubular and has a flange 501 on its middle part. A ditch 502 is formed on the circumference of said flange 501. On connecting the supporter 500 with the lower end of the pressure pipe 504, the upper part of the supporter 500 is inserted into the pressure pipe 504 and said flange 501 of the supporter 500 touches with the edge of the lower end of the pressure pipe 504. Thus a pin 505 jutting out of the edge of the lower end of the pressure pipe 504 is fixed in said ditch 502 of the flange 501 to fix the fitting angle of the supporter 500. The supporter 500 is fixed by screwing a cap nut 503 over the lower end part of the pressure pipe 504.

Figure 18:
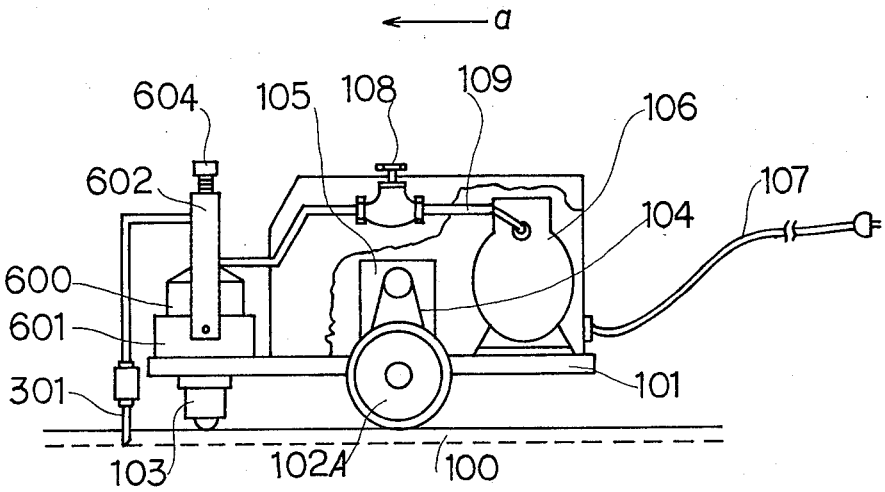
FIG. 18 is a side view partially broken away and showing another embodiment of the present invention.
Figure 19:
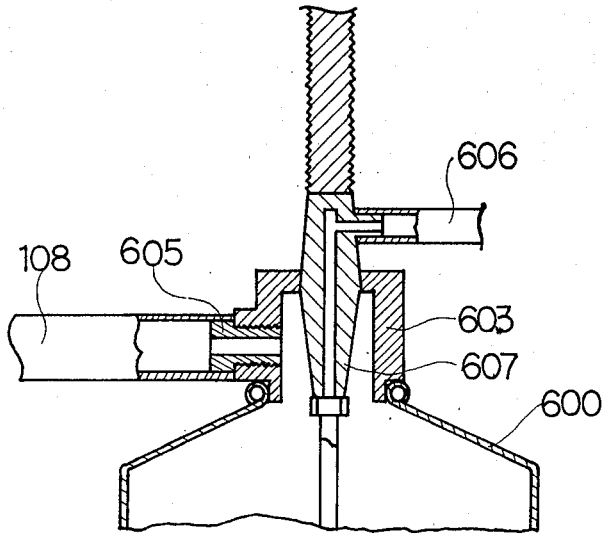
FIG. 19 is a cross-sectional view showing the upper part of the vessel in said embodiment.

Another embodiment of the vessel is shown in FIG. 18 and FIG. 19. Referring to FIG. 18 and FIG. 19, a vessel 600 is put in a box 601 installed on the front part of the base 101 and a U-shaped frame 602 is rotatably attached the both sides of said box 601 at its both ends. A fixing bolt 604 is screwed into the upper part of said U-shaped frame 602 and when said fixing bolt 604 is screwed down, the lower end of the fixing bolt 604 touches and pressed down a cap 603 of said vessel 600 to fix the vessel 600 in the box 601. Said cap 603 has a injecting port 605 connecting with the pressure pipe 109 at its side and a taking out pipe 607 is inserted into the vessel 600 from the top of the cap 603 and said taking out pipe 607 connects with the pressure pipe 606.

An advantage of said embodiment is that the vessel 600 can be easily exchanged and the sealing agent has commonly very high viscosity so filling the sealing agent into the vessel on the spot is very troublesome. In said embodiment, the used vessel is easily exchanged to the new vessel in which enough amount of the sealing agent is already filled and any troublesome work for filling the sealing agent is not necessary.

Figure 20:
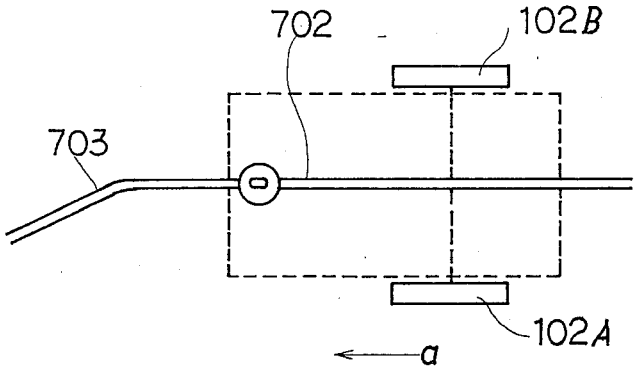
FIG. 20 is a plane view showing the movement of the present invention.

Above mentioned machine of the present invention is put above the join 702 as shown in FIG. 2 and FIG. 20 and the nozzle 201 is inserted into the joint 702. The main-wheels 102A, 102B are driven by the motor 106 through the differential gear and the machine starts to move in the direction as indicated by an arrow a in the Figures. The compressor 106 is simultaneously driven and the high pressure is put into the vessel 110 through the pressure pipe 109 to inject the sealing agent in the vessel into the joint 702 from the nozzle 201. Thus the joint 702 of the coverings 701 is filled with the sealing agent 100. The nozzle 201 inserted into the joint 702 guides the moving direction of the machine. For instance, when the nozzle 201 comes to a curve 703 of the joint as shown in FIG. 20, the nozzle 201 let the machine turn to the left. Thus the machine is a little rotated to the left. In this case, the rotational speed of the main-wheel 102A decreases while the rotational speed of the main-wheel 102B increases, so the machine can be easily rotated by the guide of the nozzle 201 without the high resistance. Accordingly, the machine rightly follows the joint 702 by the guide of the nozzle 201 so the nozzle 201 also follows the joint 702 without getting off.

We claim:

1. A sealing agent injecting machine which comprises:

(a) a frame;

(b) an axis rotatably mounted on the mid-section of the frame;

(c) a pair of wheels attached to opposing ends of the axis;

(d) a motor mounted on the frame over the mounting of the axis;

(e) a differential gear system connected to the axis, the wheels and the motor so as to enable movement of the frame;

(f) a vessel containing sealing agent mounted on the frame;

(g) a sub-wheel rotatably mounted on the frame below the vessel containing sealing agent; and (h) a nozzle connected to the vessel containing sealing agent and positioned within an area to be filled with sealing agent at a fixed angle which is obtuse to the direction of movement of the frame.

2. The sealing agent injecting machine as recited in claim 1 wherein the axis comprises axis A and axis B, wherein one of the pair of wheels is attached to one end of axis A and the second of the pair of wheels is attached to one end of axis B, and wherein the differential gear system comprises a driving gear rotatably attached to axis A; a chain suspended from the driving gear and connected to the motor; a pair of supporting bar, supporting bar A and supporting bar B, attached to one face of the driving gear; a pair of sub-axes, one sub-axis being supported at one end thereof by supporting bar A and the remaining sub-axis being supported at one end thereof by supporting bar B, such that the pair of sub-axes are parallel to the face of the driving gear to which the supporting bars A and B are attached; a pair of small bevel gears, one of which is rotatably attached to the free end of one sub-axis and the second small bevel gear is rotatably attached to the free end of the second sub-axis; and a pair of large bevel gears which gear with the small bevel gears, one large bevel gear being fixably attached to axis A and the second large bevel gear being fixably attached to axis B.

3. The sealing agent injecting machine as recited in claim 2 wherein the nozzle is positioned within an area to be filled with sealing agent at an angle of 140° to the direction of movement of the frame.

4. The sealing agent injecting machine as recited in claim 1 further comprising means for supplying pressure to the vessel containing sealing agent.

* * * * *